US012162711B2

(12) United States Patent
Brusius et al.

(10) Patent No.: US 12,162,711 B2
(45) Date of Patent: Dec. 10, 2024

(54) ADHESIVE TAPE DISPENSER, METHOD FOR NOISE-REDUCED APPLICATION OF ADHESIVE TAPE USING AN ADHESIVE TAPE DISPENSER AND USE OF ADHESIVE TAPE DISPENSERS

(71) Applicant: Enviro Group GmbH, Haiger (DE)

(72) Inventors: Daniel Brusius, Siegen (DE); Nils Brusius, Wilnsdorf (DE)

(73) Assignee: Enviro Group GmbH, Haiger (DE)

( * ) Notice: Subject to any disclaimer, the term of this patent is extended or adjusted under 35 U.S.C. 154(b) by 281 days.

(21) Appl. No.: 17/604,153

(22) PCT Filed: Apr. 15, 2020

(86) PCT No.: PCT/EP2020/060590
§ 371 (c)(1),
(2) Date: Oct. 15, 2021

(87) PCT Pub. No.: WO2020/212421
PCT Pub. Date: Oct. 22, 2020

(65) Prior Publication Data

US 2022/0194733 A1 Jun. 23, 2022

(30) Foreign Application Priority Data

Apr. 15, 2019 (EP) ..... 19169177

(51) Int. Cl.
*B65H 35/00* (2006.01)

(52) U.S. Cl.
CPC ..... *B65H 35/0026* (2013.01); *B65H 35/008* (2013.01); *B65H 2301/4132* (2013.01); *B65H 2515/82* (2013.01)

(58) Field of Classification Search
CPC ..... B65H 35/0033; B65H 35/002; B65H 35/008; B65H 35/0026
See application file for complete search history.

(56) References Cited

U.S. PATENT DOCUMENTS 3,364,096 A * 1/1968 Hetes ..... B65H 35/0033 156/577
5,676,298 A * 10/1997 Shing-Tak Lam ..... B65H 35/0013 226/88

(Continued)

FOREIGN PATENT DOCUMENTS

DE 10 2008 003 337 A1 4/2009
EP 2 966 019 A2 1/2016

(Continued)

OTHER PUBLICATIONS

International Search Report for Application No. PCT/EP2020/060590 mailing date Jul. 13, 2020, 2 pgs.

*Primary Examiner* — Alex B Efta
(74) *Attorney, Agent, or Firm* — Seed IP Law Group LLP

(57) ABSTRACT

An adhesive tape dispenser (1) includes a handle (2), a receiving apparatus (33) with a bearing (3) for an adhesive tape roll (100), an application apparatus (38) with an application roller (4), and a rotation-resistant fixed friction bridge (5) with a bridge sliding surface (6) and a deflection bead (26), wherein the adhesive tape dispenser (1) is adapted and arranged such that, during unwinding, an adhesive tape portion (103) of an adhesive tape roll (100) present on the bearing slides or is slidable over the bridge sliding surface (6), before the adhesive tape portion meets the application apparatus (38).

20 Claims, 8 Drawing Sheets

(56) References Cited

U.S. PATENT DOCUMENTS

| | | | | |
|---|---|---|---|---|
| 6,481,607 | B1 * | 11/2002 | Van Cott | B65H 35/0026 225/48 |
| 2003/0205603 | A1 | 11/2003 | Chen | |
| 2006/0169709 | A1 * | 8/2006 | Bailey | B65H 35/0073 221/26 |

FOREIGN PATENT DOCUMENTS

| | | | | |
|---|---|---|---|---|
| JP | 2000-118848 | A | 4/2000 | |
| WO | WO-9503990 | A1 * | 2/1995 | B65H 35/0033 |

* cited by examiner

ADHESIVE TAPE DISPENSER, METHOD FOR NOISE-REDUCED APPLICATION OF ADHESIVE TAPE USING AN ADHESIVE TAPE DISPENSER AND USE OF ADHESIVE TAPE DISPENSERS

BACKGROUND

Technical Field

The present disclosure relates to an adhesive tape dispenser, a method for noise-reduced application of adhesive tape using an adhesive tape dispenser, and the use of an adhesive tape dispenser.

Description of the Related Art

Adhesive tape dispensers are sufficiently known from the prior art.

EP 2 966 019 A2 discloses an adhesive tape dispenser for a roll of adhesive tape having a core element, the dispenser consisting essentially of a carrier unit. The document also discloses a metal bracket that presses an adhesive tape portion onto an application roller.

A problem of the prior art is that adhesive tape may detach from the adhesive tape dispenser too early. In this case, it can happen that detached adhesive tape portions are reconnected to the adhesive tape roll, making it difficult to detach them again. Adhesive tape portions can also become knotted, in which case, in view of the adhesive effect of the adhesive tape, unknotting is not possible and/or is very time-consuming. Another problem is that the adhesive tape may tear off if the forces acting on it become too strong.

Another problem is noise pollution at the workplace. Adhesive tape dispensers can be very noisy when applying adhesive tape. Since professional tape dispensers are often used for hours at a time and several days a week, this high noise level can be a burden on the employee and, in extreme cases, can even be detrimental to the employee's health. It is therefore advantageous if the adhesive tape dispensers apply adhesive tape as quietly as possible.

Thus, there is accordingly a need to overcome the disadvantages of the prior art and in some cases to provide an adhesive tape dispenser with which adhesive tape can be applied in a highly reliable, convenient, and low-noise manner.

BRIEF SUMMARY

Accordingly, an adhesive tape dispenser is provided comprising a handle, a receiving apparatus with a bearing, in some cases a pivotable and/or rotatable bearing, in some other cases a pivotable and rotatable bearing, for an adhesive tape roll, an application apparatus with an application roller, in some cases a rotatable application roller, a rotation-resistant fixed friction bridge with a bridge sliding surface and a deflection bead, in some cases a deflection bead with a transverse elevation, such as a transverse curvature, in some other cases a deflecting bead with a transverse elevation, such as a transverse curvature, the adhesive tape dispenser being adapted and arranged such that, during unwinding, an adhesive tape portion of an adhesive tape roll present, in some cases pivotable mounted, on the bearing, slides or is slidable over the bridge sliding surface or at least over the deflecting bead, in some cases over the transverse elevation respectively over the deflecting contact surface of the deflection bead, and if necessary subsequently over the bridge sliding surface, before it meets the application apparatus. The handle may be configured as a tangential or radial handle. The adhesive tape roll can optionally be part of the adhesive tape dispenser.

Surprisingly, the friction bridge with the deflection bead, in some cases with the transverse elevation or the deflection contact surface of the deflection bead, and in some cases also the bridge sliding surface, considerably improves the application of adhesive tape portions. It is assumed-without being bound to a theory—that attractive interactions act between the deflection bead, in some cases the transverse elevation or the deflection contact surface of the deflection bead, and in some other cases also the bridge sliding surface and the adhesive tape portion lying on it, which reduce the probability of unintentional detachment of the adhering adhesive tape portion. Among other things, these can also be Van-der-Waals forces. However, it is suspected that an electrostatic attraction between the friction-generating deflection bead, in some cases the transverse elevation respectively the deflection contact surface of the deflection bead, and/or the bridge sliding surface and the adhesive tape portion could play a not inconsiderable role. It is also surprising that these attractive forces beyond the deflection bead, in some cases the transverse elevation respectively the deflection contact surface of the deflection bead, and in some other cases also the bridge sliding surface, can bring about improved adhesion, which is possibly related to the fact that the deflection bead and in some cases also the bridge sliding surface can generate an electrostatic charge by friction, which also continues to act beyond the deflection bead respectively the bridge sliding surface. Regardless of the actual mechanism of action, the friction bridge according to the present disclosure considerably improves the applicability of the adhesive tape and reduces the probability of the adhesive tape becoming knotted. In an adhesive tape dispenser according to the present disclosure, the bridge sliding surface functions as a sliding or contact surface for the adhesive tape sliding along it, in some cases its non-adhesive rear side, but can also serve only or additionally as a contact surface. In at least one possible embodiment, the adhesive tape does not come into contact or only partially into contact with the bridge sliding surface after leaving the deflection bead when being guided along the so-called bridge sliding surface. In these embodiments, the bridge sliding surface can also simply be referred to as the bridge surface.

BRIEF DESCRIPTION OF THE DRAWINGS

Further features and advantages of the disclosure will be apparent from the following description, in which examples of embodiments of the disclosure are explained by means of schematic drawings, without thereby limiting the disclosure.

DETAILED DESCRIPTION

Figure 1:
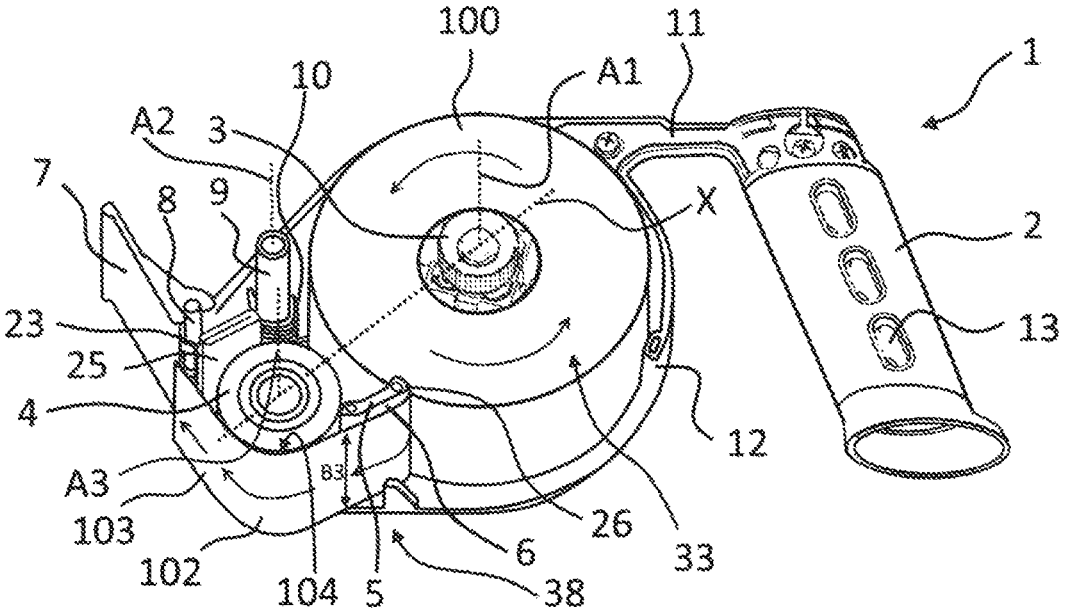
FIG. 1 shows a schematic cross-sectional view of an embodiment of the adhesive tape dispenser.

The present disclosure provides an adhesive tape dispenser comprising a handle in the form of a radial handle, a receiving apparatus with a bearing, in some cases a pivotable and/or rotatable bearing, in some other cases a central bearing, for an adhesive tape roll, an application apparatus with an application roller, in some cases a rotatable application roller, the radial handle having a longitudinal axis, the longitudinal axis, in some cases the radial handle, and the application roller being located on opposite sides of an intermediate plane, the intermediate plane being arranged parallel to the longitudinal axis of the radial handle and the bearing axis of the bearing, in some cases the central bearing, being located in a first bearing plane in the intermediate plane, and/or wherein the application roller and the bearing, in some cases central bearing, are located on the same side with respect to the longitudinal axis when a cross-section orthogonal to the bearing axis is considered. The intermediate plane is a plane to be constructed hypothetically and not an actual device object of the adhesive tape dispensing apparatus according to the present disclosure.

Optionally, the adhesive tape dispenser in this embodiment also comprises a rotation-resistant fixed friction bridge with a bridge sliding surface and a deflection bead, the adhesive tape dispenser being adapted and arranged such that, during unwinding, an adhesive tape portion of an adhesive tape roll present during unwinding, an adhesive tape portion of an adhesive tape roll present, in some cases pivotable mounted, on the bearing, slides or is slidable over the deflection bead and, if necessary, also over the bridge sliding surface, before it meets the application apparatus.

Accordingly, the present disclosure also provides an adhesive tape dispenser comprising a handle in the form of a radial grip with a longitudinal axis, a receiving apparatus with an, in some cases pivotable and/or rotatable, bearing for an adhesive tape roll, in some cases in the form of a central bearing, an application apparatus with an, in some cases rotatable, application roller, comprising a rotation-resistant fixed friction bridge with a bridge sliding surface and a deflecting bead, the adhesive tape dispenser being in some cases adapted such that, during unwinding, an adhesive tape portion of an adhesive tape roll, slides or is slidable over the deflection bead in some cases the transverse elevation and/or deflection contact surface, and in some cases also the bridge sliding surface, before it meets the application apparatus, the longitudinal axis and the application roller being located on opposite sides of an intermediate plane, wherein the intermediate plane is arranged parallel to the longitudinal axis and the bearing axis (A1) of the bearing, in some cases in a first bearing position, is arranged in the intermediate plane, and/or wherein the application roller and the bearing are on the same side with respect to the longitudinal axis when a cross-section orthogonal to the bearing axis (A1) is considered.

The radial handle allows a highly compact design if its longitudinal axis is arranged as described above. In this case, the receiving apparatus and the application roller are located on the same side of the longitudinal axis.

The present disclosure further discloses an adhesive tape dispenser comprising a receiving apparatus with a bearing, in some cases a pivotable and/or rotatable bearing, for an adhesive tape roll, an application apparatus with an application roller, in some cases a rotatable application roller, a rotation-resistant fixed friction bridge, in some cases with a bridge sliding surface, and a deflection bead, in some cases a deflection bead with a transverse elevation and/or deflection contact surface, and, if appropriate, a grip, in some cases in the form of a radial grip or tangential grip, the adhesive tape dispenser being adapted and arranged such that, during unwinding, an adhesive tape portion of an adhesive tape roll present on the bearing slides or is slidable over the friction bridge, in some cases the deflection bead, in some further the transverse elevation and/or deflection contact surface, and in some even further cases also the bridge sliding surface, before it meets the application apparatus.

Furthermore, the present disclosure discloses an adhesive tape dispenser comprising a receiving apparatus with a bearing, in some cases a pivotable and/or rotatable bearing, for an adhesive tape roll, in some cases in the form of a central bearing, an application apparatus with an application roller, in some cases a rotatable application roller, comprising a rotation-resistant fixed friction bridge, in some cases in the form of a central bearing, an application apparatus with an, in some cases rotatable, application roller, comprising a rotation-resistant friction bridge, in some cases with a bridge sliding surface, and a deflecting bead, and optionally a handle in the form of a radial handle with a longitudinal axis, the adhesive tape dispenser being arranged such that, during unwinding, an adhesive tape portion of an adhesive tape roll present on the bearing slides or is slidable over the friction bridge, in some cases the deflection bead, in some other cases the transverse elevation and/or deflection contact surface, and in some even further cases also the bridge sliding surface, before it meets the application apparatus, the longitudinal axis and the application roller being located on opposite sides of an intermediate plane, wherein the intermediate plane is arranged parallel to the longitudinal axis and the bearing axis (A1) of the bearing is located in the intermediate plane, and/or wherein the application roller and the bearing are on the same side with respect to the longitudinal axis when a cross-section orthogonal to the bearing axis (A1) is considered.

The receiving device in some cases also comprises a mechanism for swiveling the bearing, in some cases the central bearing, from the first bearing position into a second bearing position. For this purpose, the bearing is in some cases attached to a pivotable swivel arm.

In some cases, the bearing is rotatable and pivotable, in some cases rotatable about its own bearing axis and pivotable by pivoting the swivel arm about a swivel arm axis, in some cases wherein the position of the bearing axis deviates from the position of the swivel arm axis and/or wherein said axes are substantially parallel. In some cases, the bearing, in some cases central bearing, is prestressed to move from the first to the second bearing position. If the adhesive tape roll has a lot of adhesive tape on it when the adhesive tape dispenser is in use, the bearing will be at or near the first bearing position and as the amount of adhesive tape on the adhesive tape roll decreases, the bearing will automatically move closer to the second bearing position. This ensures that the friction bridge is always positioned close to the adhesive tape roll. Where reference is made in the present disclosure to the position of the bearing, the first bearing position is meant, unless the context indicates otherwise. The first bearing position is in some cases a position which is located in the center of a cylindrical housing for the adhesive tape roll.

A "handle" in the sense of the present disclosure can take various forms. Tangential and radial grips have proved highly useful. In the case of a radial grip, the grip points with its longitudinal axis in the direction of the bearing, in some cases in the first bearing position. The longitudinal axis of a radial handle does not necessarily have to lead directly through the bearing in the first bearing position and/or the bearing axis in the first bearing position, but in some cases close to it, in some other cases not more than 3 cm, in some further cases not more than 2 cm, spaced from the bearing and/or the bearing axis in the first bearing position, where the distance between the longitudinal axis and said bearing or said bearing axis in the first bearing position is shortest. In the case of the radial grip, it is provided that the shortest distance between the longitudinal axis and the bearing in the first bearing position is beyond the radial grip. In contrast, in a tangential grip, the longitudinal axis of the grip does not point to the bearing, in some cases in the first and second bearing positions. Instead, the longitudinal axis of the handle is spaced further away from the bearing and/or the bearing axis than in the radial handle, in some cases also where the distance between the longitudinal axis and said bearing and/or said bearing axis is shortest more than 3 cm, in some other cases more than 4 cm, in some further cases more than 5 cm, in some cases in the first and/or second bearing position. In the case of the tangential grip, it is provided that the shortest distance between the longitudinal axis and the bearing, in some cases in the first bearing position, is at a point of the longitudinal axis within the tangential grip. While the longitudinal axis of a radial grip in some cases passes through an area in which the adhesive tape roll is present during generic use, this is usually not the case with the tangential grip. The longitudinal axis of a tangential handle usually does not come close to the adhesive tape roll in the generic use, in some cases has a minimum distance of 3 cm from the outer area of the adhesive tape roll. The longitudinal axis of the handle may also be referred to as the handle axis. In some cases, it is the central axis of the handle, which leads directly through the handle along its longitudinal extension. Both tangential and radial handles can have a basic cylindrical shape, with the cross-section usually being elliptical rather than round. In some cases, tangential and radial handles are linear and not curved.

An "adhesive tape portion" in the sense of the present disclosure may be connected to the adhesive tape roll, but is in some cases already no longer radially attached to the core of the adhesive tape roll, but is detached, but in some cases still terminally connected to the rest of the adhesive tape roll. It is thus a portion of adhesive tape projecting entirely or partially from the adhesive tape roll, which is connected to the adhesive tape roll terminally and/or in one piece, provided that it has not yet been cut off. Usually, the adhesive tape portion comprises an adhesive tape side and an opposite non-adhesive tape side. This is usually achieved by coating the adhesive tape with an adhesive layer on one side only. After application of the adhesive tape portion with the adhesive tape dispenser, i.e., after application of the adhesive tape portion to a surface, it is usually cut off and a further adhesive tape portion can be applied. Said further adhesive tape portion is already completely or partially detached from the adhesive tape at the time of cutting. It should be noted that the adhesive tape roll and the adhesive tape portion are only optional components of the adhesive tape dispenser and that an adhesive tape dispenser without an adhesive tape roll is also claimed.

"Rotation-resistant" in the sense of the present disclosure means that the corresponding element is not rotatably fixed, for example connected thereto or glued or screwed thereto in one piece. Of course, the adhesive tape dispenser as a whole can be applied by a user and thus also the rotation-resistant elements. What is meant is that a rotation-resistant element does not rotate with respect to the base body of the rest of the adhesive tape dispenser, in some cases not with respect to the handle or possibly the housing. The reference system is therefore the adhesive tape dispenser itself, for example also the handle and possibly the housing of the adhesive tape dispenser. In contrast to a rotation-resistant fixed element, a rotatable element is rotatably connected to the rest of the adhesive tape dispenser. In some cases, the corresponding element also cannot perform a partial rotational and/or pivoting movement with respect to the reference system. A pivotable element is to be understood analogously with the same reference system.

In some cases, the adhesive tape dispenser is adapted for an adhesive tape having an adhesive tape width and the deflection bead comprises a deflection contact surface which is less wide than the adhesive tape width of the adhesive tape, wherein the adhesive tape portion of the adhesive tape has adhesive tape edges and, in the generic use of the adhesive tape dispenser, is spaced from the deflection contact surface with its adhesive tape edges when sliding over the deflection bead, in some cases spaced from the deflection bead. In some cases, said deflection contact surface includes. This reduces the noise emission.

In some cases, the adhesive tape dispenser is adapted for an adhesive tape with an adhesive tape width of at least 47 mm, wherein the deflection contact surface has an adhesive tape width of less than 43 mm, in some cases less than 40 mm. In some embodiments, the adhesive tape dispenser is designed for an adhesive tape having an adhesive tape width of 47 to 51 mm, wherein the deflection contact surface has a contact surface length of less than 43 mm, in some cases of less than 40 mm. In some embodiments, the deflection bead is configured to guide a polyvinyl chloride packing tape portions of a polyvinyl chloride packing tape roll having an adhesive tape width of 48 to 50 mm along said deflection bead such that the edges of the polyvinyl chloride packing tape portion do not contact the deflection bead, in some cases do not contact the friction bridge on the deflection bead. In at least one embodiment, the adhesive tape dispenser is designed for an adhesive tape having an adhesive tape width of 37 to 51 mm, wherein the deflection contact surface has a contact surface length of less than 37 mm, in some cases of less than 35 mm. The contact surface length is in some cases determined orthogonally to the direction in which the adhesive tape portion slides over the deflection bead and in some other cases also over the bridge sliding surface.

In some embodiments, the deflection bead comprises a transverse elevation, such as a transverse curvature. It has been shown that the noise when the adhesive tape roll is stripped is reduced by the transverse elevation, in some cases transverse curvature. Without being bound to a theory, it is assumed that the adhesive tape edges of the adhesive tape vibrate on contact and that this vibration does not occur to the same extent when a transverse elevation, such us transverse curvature, prevents said contact at the deflection bead. The vibration may generate noise in a high frequency range.

In some cases, the deflection bead comprises said transverse elevation, wherein the transverse elevation is configured and arranged to marginally distance the adhesive tape portion from the deflection bead while the adhesive tape portion contacts the transverse protrusion away from the adhesive tape margins. In some cases, the transverse elevation, in some cases the transverse curvature, is provided to distance the edges of the adhesive tape portion of an adhesive tape roll with an adhesive tape width of 48 mm to 50 mm from the deflection bead in the generic use.

In some cases, the deflection bead comprises a deflection contact surface with which the adhesive tape portion is in contact during said generic use of the adhesive tape dispenser for applying adhesive tape. In some embodiments, the adhesive tape edges of the adhesive tape are not in contact with said deflection contact surface, in some cases with the deflection bead, during said generic use of the adhesive tape dispenser for applying adhesive tape. In a highly useful embodiment, the deflection bead is integral with the bridge sliding surface or the element forming the bridge sliding surface. In some cases, the deflection bead and the bridge sliding surface are integral components of the friction bridge.

In some cases, the transverse elevation, in some cases at a distance from the friction bridge sides, has a transverse elevation maximum at which the adhesive tape portion makes contact, while the transverse elevation beyond the transverse elevation maximum has, in some cases two or more marginal, transverse elevation minima, at which the adhesive tape portion, in some cases the adhesive tape edges of the adhesive tape portion, does not make contact during the generic use of the adhesive tape portion for applying adhesive tape.

In some cases, the transverse elevation extends between opposing friction bridge sides of the friction bridge. In some embodiments, the transverse elevation extends from or toward a first friction bridge side to or toward a second friction bridge side. In some cases, the transverse elevation has a transverse elevation maximum that is present between and spaced from the friction bridge sides, in some cases spaced centrally between the friction bridge sides. In at least one embodiment, the transverse elevation spans a polygonal or continuous arc from the first to the second friction bridge side.

The transverse elevation can be arranged as a transverse curvature. Alternatively or additionally, a polygonally shaped transverse elevation is also conceivable. In some embodiments, the polygonally shaped transverse elevation has a cross-section in which it has two legs, which comprise transverse elevation minima, and a linear connecting line between the legs, which comprises the transverse elevation maximum.

In some cases, the transverse elevation has at least one cross-section which extends orthogonally to the running direction of the adhesive tape portion at the transverse elevation and/or to the deflection sliding surface, the transverse elevation being visible in said cross-section as a raised and/or curved contour. Alternatively or additionally, the transverse elevation has at least one cross-section which extends parallel to the bridge sliding surface, the transverse elevation being visible in said cross-section as a raised and/or curved contour. If the deflection curvature does not have a transverse elevation, it may be provided that in said cross-sections the deflection curvature is not visible as a raised and/or curved contour, but as a straight line.

The adhesive tape dispenser comprises a receiving apparatus. In at least one embodiment, the receiving apparatus may comprise a support plate, a closed housing or a semi-closed housing. In some cases, the housing is adapted and arranged to receive the adhesive tape roll and optionally also to hold the cutter blade as well as the application roller. A closed or semi-open housing with a cylindrical recess for an adhesive tape roll is expedient. In at least one embodiment, the cutter blade is releasably connected to the receiving apparatus, in some cases the housing, in some cases wherein no tools are required to release the cutter blade. For example, a clamping mechanism has proven to be suitable.

In some embodiments, it is provided that the adhesive tape portion, after being detached from the adhesive tape roll, is guided with the adhesive side contact-free over the applicator roller and/or the friction bridge, in some cases slides over the latter with the non-adhesive side in contact. In some cases, the receiving apparatus does not contact an adhesive tape, in some cases the adhesive tape portion, on the adhesive side in the generic use, but only on the non-adhesive side.

In some cases the receiving apparatus, in some cases the friction bridge and/or application roller, is arranged and adapted to adhere to the non-adhesive side of the adhesive tape, in some cases to the non-adhesive side of the adhesive tape portion. The adhesion may be based, for example, on van-der-Walls forces and/or electrostatic attraction forces. However, unlike the adhesive side, no adhesive is provided for adhesion. Metal brackets are also known from the prior art, which rest on the adhesive side and prevent the adhesive tape from coming off. However, these have the disadvantage that friction is considerably increased. Surprisingly, such metal brackets are unnecessary in the present disclosure.

The receiving apparatus comprises a bearing for a roll of adhesive tape. In some cases, the bearing is fully or partially rotatable so that adhesive tape portions can be unrolled from the adhesive tape roll. In principle, it is also conceivable that the adhesive tape roll comprises a rotational bearing and is mounted on a rotation-resistant fixed bearing of the adhesive tape dispenser. In any case, it is expedient that an adhesive tape roll connected to the bearing is rotatable, in some cases rotatable about a bearing axis.

In some cases, the bearing of the present disclosure is arranged as a central bearing, i.e., the bearing is arranged centrally with respect to the adhesive tape roll when an adhesive tape roll is attached to the bearing according to the disclosure. In principle, there are also bearings which are not centrally located on the adhesive tape roll. However, central bearings have proved highly effective.

The application device comprises an application roller. The application roller can be used to press the adhesive tape portion against the substrate to be covered with the adhesive tape in order to achieve adhesion. In some cases, the application roller has a rolling surface made of or comprising plastic. The plastic is in some cases more elastic and/or softer than the material, in some cases the synthetic material, of the friction bridge, in some expedient cases the deflection bead and/or the bridge sliding surface.

Although the application roller and the friction bridge are optimized for contact with the adhesive tape portion, a more elastic and/or softer rolling surface has proven to be advantageous. In this case, the rolling surface can compensate for unevenness of the substrate to which the adhesive tape is to be applied by a certain softness and/or elasticity, so that more uniform pressing is facilitated. Also, the frictional resistance of the application roller, when it is not rotating, is in some cases higher than the frictional resistance of the deflection bead and/or the bridge sliding surface. In many cases, it has therefore proved useful to select a softer material for the rolling surface and/or application roller than for the friction bridge.

In an expedient embodiment, the rolling surface and/or application roller is provided with a powder, in some cases coated. In at least one embodiment, the powder is talc or talc in powder form. The powder adheres to the roller surface and/or application roller and improves the unwinding of the adhesive tape. This works well if the rolling surface is more elastic and/or softer than the material, in some cases the plastic, of the friction bridge, especially the deflection bead and/or the bridge sliding surface.

In at least one embodiment, the friction bridge is located between the application roller and the bearing, in some cases when the bearing is in the second bearing position.

In an expedient embodiment, the friction bridge and/or deflection bead and/or bridge sliding surface is installed in the adhesive tape dispenser in a rotation-resistant manner such that it does not come into contact, in some cases cannot come into contact, with said flat substrate during generic use for applying adhesive tape to a flat substrate. This facilitates unrolling.

In some cases, the friction bridge is designed and arranged to come into contact with the non-adhesive side of an adhesive tape in the generic use.

It is also expedient if the bridge sliding surface has a bridge sliding surface length that is greater than or substantially equal to the length of the application roller. Two lengths are substantially equal at least if the longer of the lengths is not more than 20%, in some cases not more than 10%, longer. In some cases, it has also been shown that the larger the bridge sliding surface, the better the adhesion of the adhesive tape portion to the bridge sliding surface.

In some cases, the friction bridge and/or the deflection bead and/or the bridge sliding surface has a sliding surface width which is at least 10% of the sliding surface length of the deflection bead and/or the bridge sliding surface, in some cases at least 25%. However, the sliding surface width should in some cases not be more than 200%, in some other cases not more than 100%, in some further cases not more than 70%, of the sliding surface length of the bridge sliding surface. A comparatively large sliding surface width of the deflection bead and/or the bridge sliding surface ensures better adhesion of the adhesive tape portion. However, if the sliding surface width of the bridge sliding surface becomes too large, it is more difficult to accommodate it within the adhesive tape dispenser in a space-saving manner. Said sliding surface width is in some cases determined in the direction in which the adhesive tape portion slides over the bridge sliding surface. In some cases, said sliding surface length is determined orthogonally to this direction.

In some cases, the friction bridge and/or the deflection bead and/or the bridge sliding surface has a bridge width which is at least 10% of the bridge length of the friction bridge, in some other cases at least 25%. However, the bridge width should in some cases not be more than 200%, in some further cases not more than 100%, in some even further not more than 70%, of the bridge length of the friction bridge. Said bridge width is in some cases determined in the direction in which the adhesive tape section slides over the bridge sliding surface. Said bridge length is in some cases determined orthogonally to this direction.

In some cases, the bridge sliding surface has a size of at least 1 $cm^2$, in some other cases at least 2 $cm^2$, in some further cases at least 5 $cm^2$.

In some cases, the friction bridge comprises a plastic, in some cases consists predominantly, i.e., at least 50%, of this, in some other cases at least 80% or completely. In principle, a friction bridge made of metal is also conceivable, but plastics have proved highly suitable. In some cases, said plastic is selected from a group consisting of polyamide, polycarbonate, acrylonitrile-butadiene-styrene, styrene-acrylonitrile copolymer, polyacetals, in some other cases polyoxyethylene (POM), polyurethane, polyketone, polyester-urethane rubber, polyetherketone, in some further cases PEK, PEKK, PEEEL, polymethacrylate. Hard plastics have proven to be highly suitable, especially with regard to adhesion properties and friction. In some cases, the friction bridge comprises the plastic polyamide, in some other cases polyamide 6.6 or polyamide 6. Polyamide 6.6 has proven to be highly suitable. Polyoxymethylene (POM) has also proved to be highly suitable. With POM, it was found that friction is reduced and electrostatic charging is improved. It was found that polyamide and/or polyoxymethylene, in some cases polyoxymethylene, is associated with improved, in some cases electrostatic, adhesion of adhesive tape portions to the deflection bead and/or, the bridge sliding surface. In some cases, the transverse elevation and/or deflection contact surface of the deflection bead or the deflection bead or the bridge sliding surface, in some cases the friction bridge, or the transverse elevation and/or deflection contact surface of the deflection bead and the bridge sliding surface or the deflection bead and the bridge sliding surface contain polyamide, in some other cases polyamide 6. 6 and/or polyamide 6, and/or a polyacetal, in some further cases polyoxymethylene, or, in some cases, consist thereof, polyoxymethylene being expedient.

In some cases, the above-mentioned plastic of the friction bridge forms the surface of the bridge sliding surface and/or deflection bead, in some cases the surface of the entire friction bridge. In some cases, the bridge sliding surface and/or the deflection bead consists of one of the mentioned plastics, in some other cases polyamide and/or polyoxymethylene, or is formed therefrom as an essential component. The core of the friction bridge can also be formed from another plastic, for example that of the other components of the adhesive tape dispenser, or can be made from another material, for example a metal. In a further embodiment, the friction bridge is formed in one piece, in some cases from one of the plastics mentioned.

In some cases, the friction bridge is rotation-resistant fixed by at least one, in some cases mechanical, fixing element. Alternatively or additionally, the friction bridge can be bonded to the rest of the adhesive tape dispenser or be made in one piece with it. Screws, nails, bolts, etc. have proved highly suitable as fixing elements, which can be made of metal or plastic, for example. In some cases, the friction bridge is rotation-resistant fixed via a first and second fixing element. Two to four fixing elements are highly suitable for preventing any rotation.

The friction bridge can comprise at least one stiffening leg. The stiffening leg provides additional stability. A first stiffening leg may be provided at the first fixation means and a second stiffening leg may be provided at the second fixation means.

In some cases, the friction bridge is rotation-resistant fixed to the remainder of the adhesive tape dispenser at at least four points.

The friction bridge comprises a deflection bead. In some cases, the adhesive tape portion is deflected at the deflection bead during the generic use of the adhesive tape dispenser, in some cases by at least 45°, in some other cases by at least 90°, and in some further cases by more than 90°.

The deflection bead can be connected to the bridge sliding surface in one piece. It can also be designed as a deflection pin. The deflection pin is designed to be rotatable or rotation-resistant fixed, in some cases rotation-resistant fixed. The deflection bead can also be formed at a distance from the bridge sliding surface, in some cases at a distance through a bridge recess.

In some cases, the deflection bead is rounded with a central bevel circle. In some cases, the rounding or a cross-section of the rounding has at least one rounded area with a point, in some cases a second point, whose bevel circle, also called a circle of curvature, has a mean bevel circle radius, in some cases a second mean bevel circle radius, of 0.1 mm to 50 mm, in some other cases 0.2 mm to 20 mm, in some further cases 0.7 to 10 mm. The deflection bead can also be formed by a deflection pin with said mean bevel radius.

In some cases, the friction bridge comprises a, in some cases concave, receiving curvature. In some cases, the receiving curvature ensures that the friction bridge does not collide with the application roller, i.e., friction between the application roller and the friction bridge is prevented by the recess in this area. In some cases, the application roller is adjacent to the receiving curvature.

In a practical embodiment, the friction bridge comprises a deflection section, in some cases a, in some cases rounded, deflection edge. In some cases, the deflection section is arranged to release the adhesive tape portion from the friction bridge if it is in contact therewith. In numerous embodiments, the deflecting section, in some cases the deflecting edge, marks one end of the bridge sliding surface. The deflecting section, in some cases the deflecting edge, or bridge sliding surface may be followed by a surface that is inclined relative to the bridge sliding surface. In some embodiments, the friction bridge comprises said deflecting section, in some cases said deflecting edge, wherein the deflecting section is closer to the application roller than the deflecting bead, in some cases wherein the adhesive tape dispenser is adapted and arranged such that, during unwinding, an adhesive tape portion of an adhesive tape roll present on the bearing slides over the deflecting section and is deflected there and/or separates from the friction bridge. It can be provided that the adhesive tape does not contact or only partially contacts the inclined surface in the generic use.

In some embodiments, the friction bridge comprises a rounded contact bead in addition to the deflection bead. In some cases, the rounded contact bead is intended to accept the adhesive tape, in some cases to detach it. The deflection bead can also be rounded and accept the adhesive tape. Thus, a contact bead is not absolutely necessary. If a contact bead is provided, it has proved useful if the deflection bead is less rounded than the contact bead, in some cases if the rounding of the contact bead describes a larger mean bevel circle radius. In some cases, the contact bead is provided closer to the deflection bead than to the deflection section, in some cases the deflection edge. In some cases the bridge sliding surface extends to the deflection bead and beyond the deflection bead is the rounded contact bead. In some embodiments, the adhesive tape first contacts the rounded contact bead of the friction bridge during unrolling.

In some expedient embodiments, a contact bead is not provided and the, in some cases rounded, deflection bead receives the adhesive tape during generic use.

In some cases, the deflection bead merges continuously into the bridge sliding surface, in some cases continuously in the mathematical sense and/or without forming a sharp edge.

In some cases, said contact bead has in cross-section a rounded area with a first point whose bevel circle has a first mean bevel circle radius. In some cases, said deflection bead has in cross-section a rounded area with a second point whose bevel circle has a second mean bevel circle radius.

In at least one embodiment, the second mean bevel radius is several times smaller than the first mean bevel radius, in some cases at least three times smaller. In some cases, the second mean beveling circle radius is 0.1 mm to 10 mm, in some other cases 0.2 mm to 3 mm, in some further cases 0.7 to 2 mm. It is assumed that a smaller second mean beveling circle radius is associated with greater friction and thus with greater electrostatic charging.

In some cases, the bearing for an adhesive tape roll, which is rotatable in some cases about its own axis, can be pivoted between a first and a second bearing position, in some cases from the first to the second bearing position and no further in each case and also vice versa, the bearing being fastened to a swivel arm which is connected to a prestressed swivel arm spring, the swivel arm spring urging the swivel arm and the bearing in the direction of the second bearing position, the bearing being closer to the deflection bead of the friction bridge in the second bearing position than in the first bearing position. In some cases, the crossbar for the activation plate is oriented orthogonally to a pivot rod, wherein the swivel arm pivots about the pivot rod.

In some cases, at least one fixing cantilever is provided opposite the bridge sliding surface, in some cases a first and, in some cases opposite, second fixing cantilever, in some cases wherein a passage is located between the first and second fixing cantilever. In some cases, the at least one fixation cantilever does not contact the adhesive tape portion in the generic use and is spaced from the bridge sliding surface and the friction bridge. In some cases, the at least one fixation cantilever is fixedly installed, i.e., is neither rotatable nor pivotable. The fixation cantilever additionally secures the adhesive tape portion and shields the bridge sliding surface.

In some cases, the handle has a longitudinal axis, in some cases the longitudinal axis already described, the longitudinal axis and the application roller being located on opposite sides of an intermediate plane, the intermediate plane being arranged parallel to the longitudinal axis and the bearing axis of the bearing in the first bearing position being located in the intermediate plane. In at least one embodiment, this longitudinal axis is less than 5 cm, in some cases less than 3 cm, away from the bearing in the first bearing position. This allows for a highly efficient and compact design.

In an expedient embodiment, the bearing for an adhesive tape roll can be pivoted into such a position that a line and/or plane connecting the applicator roll axis and the bearing axis of the bearing can be defined, which is substantially parallel to at least a portion of the bridge sliding surface. "Essentially parallel" means that the deviation from an exactly parallel orientation is less than 20°, in some cases less than 10°, in some other cases less than 5°. This may be the case, for example, in the first bearing position or in a third bearing position, the third bearing position being located between the first and second bearing positions. In some cases, it is alternatively or additionally provided that the bridge sliding surface is substantially parallel to the application roller axis and/or bearing axis. In at least one embodiment, a line connecting the application roll axis and bearing axis is definable, wherein the bridge sliding surface is oriented substantially parallel to this line and substantially parallel to the application roll axis and/or bearing axis.

In some embodiments, the bridge sliding surface is curved. In some cases, however, the bridge sliding surface is flat and planar, i.e., without curvature.

In a further expedient embodiment, the adhesive tape dispenser comprises a, in some cases removable, cutter blade, in some cases with a serration, which can be transferred from a shielded first blade position to a second blade position in which the cutter blade protrudes freely. In some cases, it has also been shown that the cutting blade facilitates cutting off the adhesive tape strip after application. The two blade positions reduce the risk of injury and also prevent accidental severing. For example, a button or slider can be provided with which the blade is extended manually. However, it has often proved useful if the adhesive tape dispenser comprises a prestressed activation plate, whereby the prestressed activation plate, when loaded with pressure and moved, transfers the cutting blade against the direction of movement of the activation plate into the second measuring position, in which the cutting blade protrudes freely. This mechanism facilitates the cutting of the adhesive tape.

In some cases, the cutter blade is connected to or encloses a receiving block, whereby the receiving block can facilitate fixing of the cutter blade and replacement of the cutter blade. In some cases, the cutter blade can be detached from the receiving block, in some cases detached without tools.

In some embodiments, the adhesive tape dispenser comprises an activation plate spring having a first wire helically wound around a crossbar and a second wire helically wound around said crossbar, wherein the first and second wires are integrally connected by a bracket, the activation plate having a recess and/or cantilever for fixing the bracket. Surprisingly, it has been shown that the separation of an applied adhesive tape portion now takes place better. This is by no means a matter of course. Insofar as activation plates are described in the prior art, the transverse bar is considered sufficient to rotatably fix the activation plate spring. However, additional fixation is achieved by means of the recess and/or cantilever. In principle, bonding is also possible, but mechanical fixation has proved highly effective, in some cases by clamping or holding the bracket by means of the recess and/or cantilever. It is assumed that the activation plate now strikes harder, which facilitates clean separation of an applied adhesive tape portion.

The activation plate may additionally comprise reinforcing elements, in some cases a first and second reinforcing element.

In some cases, the adhesive tape dispenser comprises an end sliding surface, in some cases adjacent to a gap through which the cutting device, in some cases the cutting blade, exits. In at least one embodiment, the end sliding surface comprises metal, in some cases aluminum. It is thus provided shortly before the end at which the adhesive tape portion is cut off. The end sliding surface can therefore also be referred to as the end contact surface for an adhesive tape portion. The end sliding surface or the end contact surface helps to guide the adhesive tape, whereby a decisive role of electrostatic interactions is assumed without being bound to a theory.

In at least one expedient embodiment, the adhesive tape dispenser comprises an adhesive tape roll and an adhesive tape portion unrolled from the adhesive tape roll and connected to the adhesive tape roll, the adhesive tape portion having an adhesive tape side and an opposite non-adhesive tape side, wherein the opposite non-adhesive tape side abuts with a partial area against the deflection bead and the application roller or against the deflection bead and the bridge sliding surface and the application roller.

In another expedient embodiment, the adhesive tape dispenser does not comprise, but is suitable for, an adhesive tape roll and an adhesive tape portion unrolled from the adhesive tape roll.

In some cases, the adhesive tape dispenser is adapted and arranged to guide the adhesive tape portion around the deflection bead during application, wherein the adhesive tape edges are spaced from said deflection bead at least in certain areas, while the adhesive tape portion rests centrally on the deflection bead. The disclosure also relates to an adhesive tape dispenser for noise-reduced application of adhesive tape with an adhesive tape dispenser as described above, wherein an adhesive tape portion is guided around a deflection bead during application and the adhesive tape edges are spaced at least in regions from said deflection bead, while the adhesive tape portion rests centrally on the deflection bead.

The present disclosure also relates to a method for noise-reduced application of adhesive tape with an adhesive tape dispenser as described above, wherein the adhesive tape portion is guided around a deflection bead during application and the adhesive tape edges are spaced apart from said deflection bead at least in certain areas, while the adhesive tape portion rests centrally on the deflection bead.

The present disclosure is based on the surprising realization that a deflection bead combined with a rotation-resistant bridge sliding surface brings considerable improvements in the application of adhesive tape portions. The adhesive tape portion adheres by means of the friction bridge. Surprisingly, a metal bracket that presses the adhesive tape portion against the application roller is no longer required. Rather, it has been shown that the friction bridge can be used to effect adhesion toward or to the application roller, in some cases without an element from the adhesive side of the adhesive tape portion. Knotting or accidental detachment is prevented. The concrete shape and, in some cases, the orientation and positioning of the deflection bead and, in some cases, of the bridge sliding surface, as well as, above all, a suitable choice of material, can further improve said adhesion. While there are solutions in the prior art to ensure the transfer of the adhesive tape to the cutting blade, the present disclosure shows that a considerable improvement is nevertheless possible by carefully controlling the path of the adhesive tape without changing the adhesive tape itself. Also, with numerous of the described embodiments, the noise development could be reduced, in some cases with a transverse elevation. In some cases, it has proved to be very advantageous that after cutting off a portion of adhesive tape with the cutting blade of the adhesive tape dispenser according to the disclosure, the adhesive tape remains in contact with the end sliding surface or end contact surface. In this way, the adhesive tape is immediately available for the subsequent gluing process. A further advantage is that the adhesive tape, after leaving the rotation-resistant fixed friction breaks containing the deflection bead and the bridge sliding surface, reaches the end sliding surface/end contact surface reliably and reproducibly via the application roller without folding over on itself under adhesion. This also ensures safe working, with no rejects in the form of adhesive tape to be discarded.

Turning to the drawings, FIG. 1 shows the adhesive tape dispenser 1 comprising a handle 2 in the form of a tangential handle, a receiving apparatus 33 with a bearing 3, in some cases a pivotable and/or rotatable bearing 3, for an adhesive tape roll 100, an application apparatus 38 with an application roller 4, in some cases a rotatable application roller 4, a rotation-resistant fixed friction bridge 5 with a bridge sliding surface 6 and a deflection bead 26, the adhesive tape dispenser 1 being adapted and arranged such as, during unwinding, an adhesive tape portion 103 of an adhesive tape roll 100 present on the bearing slides or is slidable over the bridge sliding surface 6 in the receiving device by means of the deflecting bead, before it meets the application apparatus. The adhesive tape portion 103 comprises an adhesive tape side 102 and a non-adhesive tape side 104. The adhesive tape dispenser 1 comprises a cutter blade 23 having a serration, which is transferable from a shielded first blade position to a second blade position in which the cutter blade 23 protrudes freely. Shown here is the first cutter blade position. The adhesive tape dispenser 1 further comprises a prestressed activation plate 7, wherein the prestressed activation plate 7, when loaded with pressure and moved, transfers a cutter blade 23 against the direction of movement of the activation plate 7 to a second blade position in which the cutter blade 23 freely protrudes. The activation plate is rotatably mounted around a transverse rod 8. A pivot rod 9 permits pivoting of the bearing 3 by means of the swivel arm spring 10. This mechanism of pivoting is explained in more detail in connection with FIG. 7. The handle 2 includes handle holes 13 and is connected to the rest of the adhesive tape dispenser by a connector 11. The adhesive tape roll 100 is present in a semi-open cylindrical housing 12. The bearing 3 is rotatable about a bearing axis A1, a swivel arm (cf. FIG. 7) is pivotable about a swivel arm axis A2, and the applicator roll 4 is rotatable about an applicator roll axis A3. The bearing 3 in the form of a central bearing for an adhesive tape roll 100 can be pivoted into such a position that a line X is defined between an application roller axis A3 of the application roller 4 and a bearing axis A1 of the bearing 3, which runs parallel to the central orientation of the bridge sliding surface 6 (at present not yet completely parallel).

Figure 2:
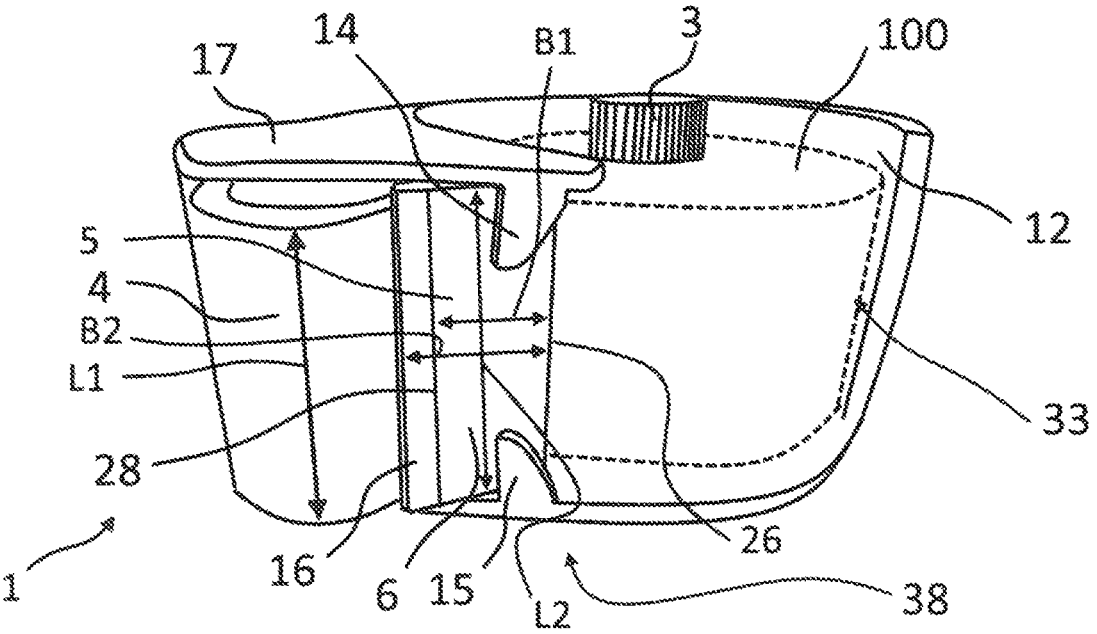
FIG. 2 shows a perspective view of an embodiment of the adhesive tape dispenser from the direction of the application roller and the friction breaks.

FIG. 2 shows a section of the adhesive tape dispenser 1 from the direction of the friction bridge 5 with the bridge sliding surface 6. The friction bridge 5 comprises a deflection section 28 in the form of a deflection edge, the deflection section 28 being closer to the application roller 4 than the deflection bead 26. The receiving device 33 comprises the half-open cylindrical housing 12, in which the adhesive tape roll 100 is accommodated and rotatably mounted on the bearing 3 in the form of a central bearing. The applicator device 38 comprises a rotatable applicator roller 4. A surface 16 inclined with respect to the bridge sliding surface 6 can also be seen, these being separated from each other by the deflecting section 28. A first fixing cantilever 14 and a second fixing cantilever 15 are spaced apart and opposite from the bridge sliding surface 6. The application roller 4 is rotatably mounted to a leg 17 of the semi-open cylindrical housing 12. The handle has not been reproduced in FIG. 2 for reasons of clarity. The bridge sliding surface has a sliding surface length L2 which is greater than or substantially equal to the application roller length L1 of the application roller. The application roller length L1 is usually selected to match the adhesive tape width of the adhesive tape. Also, the bridge sliding surface has a sliding surface width B1 and the friction bridge has a bridge width B2, which is at least 25% of the sliding surface length of the bridge sliding surface L2.

Figure 3:
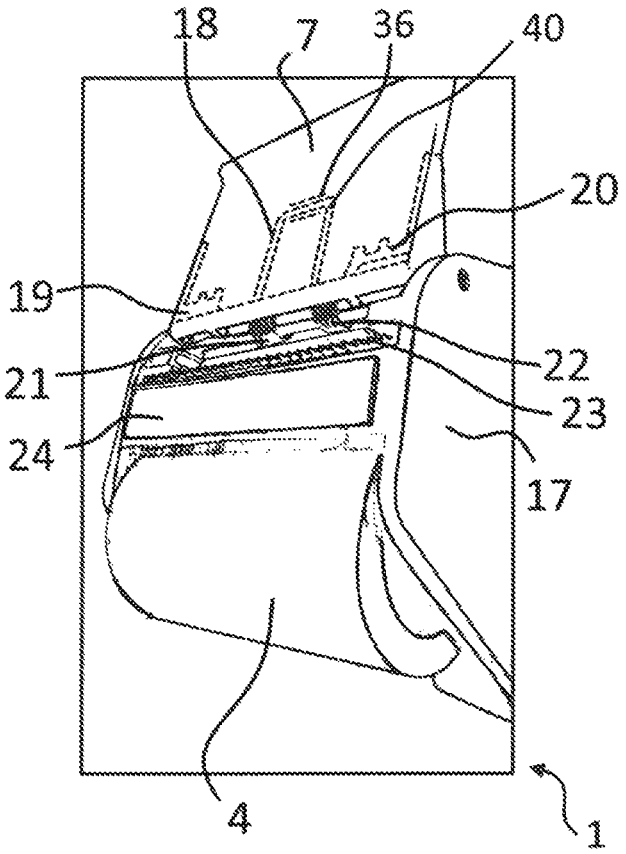
FIG. 3 shows a perspective view of an embodiment of the adhesive tape dispenser from the direction of the activation plate and the cutting blade.

FIG. 3 shows a section of the adhesive tape dispenser 1 from the direction of the cutting blade 23 and the prestressed activation plate 7. Said cutting blade 23 with a serration can be seen, which can be transferred from a shielded first cutting blade position into a second cutting blade position, in which the cutting blade 23 protrudes freely. For this purpose, the adhesive tape dispenser 1 comprises said prestressed activation plate 7, wherein the prestressed activation plate 7, when loaded with pressure and moved, transfers the cutting blade 23 against the direction of movement of the activation plate 7 into a second cutting blade position, in which the cutting blade 23 protrudes freely. The activation plate 7 comprises an activation plate spring 40 with a first wire 21 wound in helical form around a transverse bar and a second wire 22 wound in helical form around a transverse bar, the first and second wires 21, 22 being integrally connected by a bracket 18, the activation plate 7 having a recess and/or cantilever for fixing the bracket 18. The arc is shown dashed, as it is actually hidden by the activation plate 7. The activation plate 7 comprises first and second reinforcing elements 19, 20 and a recess 36 for the bracket 18. Between the cutting blade 23 and the application roller 4 there is an end sliding surface/end contact surface 24, which are held by legs 17 of the semi-open cylindrical housing.

Figure 4:
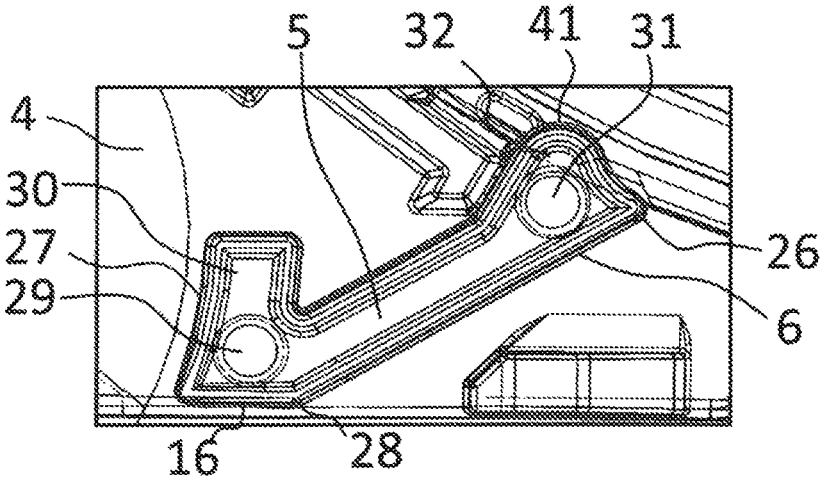
FIG. 4 shows a schematic cross-sectional view of an embodiment of the friction bridge.

FIG. 4 shows the friction bridge 5 with the bridge sliding surface 6 and a deflection bead 26 as well as a deflection portion 28 in the form of a deflection edge. In this embodiment, the bridge sliding surface 6 extends from the deflection bead 26 to the deflection portion 28. A first stiffening leg 30 comprises a first mechanical fixing element 29 and a second stiffening leg 32 comprises a second mechanical fixing element 31. A surface 16 inclined with respect to the bridge sliding surface 6 is delimited by the deflection portion 28. The friction bridge 5 includes a rounded contact bead 41 for receiving the adhesive tape roll and a concave receiving curvature 27 to prevent frictional contact with the application roller 4. The adhesive tape roll thereby presses on the contact bead 41. The deflecting bead 26 and, in an expedient embodiment, also the bridging sliding surface 6 contact the adhesive tape, which results in improved adhesion of the adhesive tape with the non-adhesive side.

Figure 5:
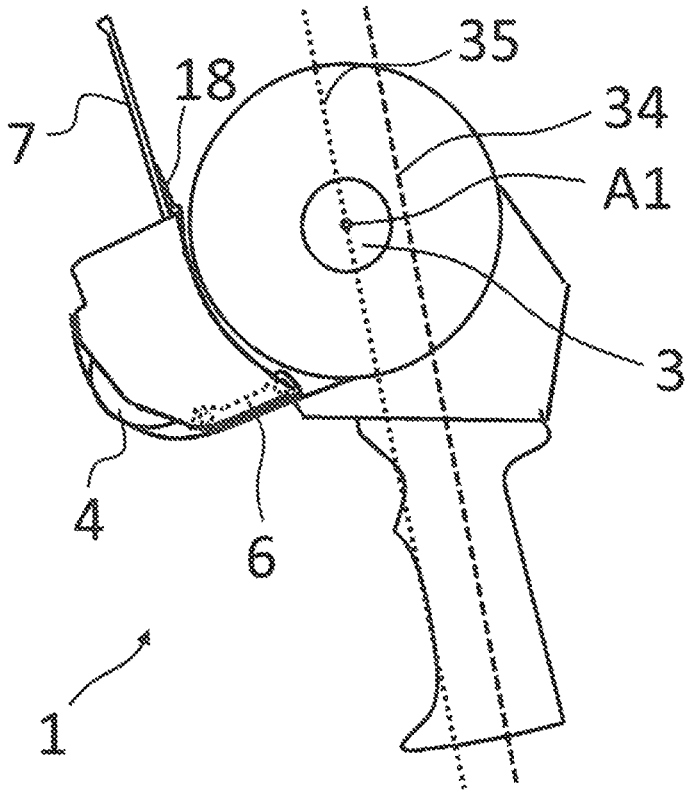
FIG. 5 shows a schematic view of a further embodiment of the adhesive tape dispenser.

FIG. 5 shows a schematic view of an alternative embodiment of the adhesive tape dispenser 1. Here, the handle 2 in the form of a radial handle has a longitudinal axis 34, wherein the longitudinal axis 34 and the application roller 4 are located on opposite sides of an intermediate plane 35, wherein the intermediate plane 35 is located parallel to the longitudinal axis 34 and the bearing axis R of the bearing 3 in the form of a central bearing in the first bearing position is located in the intermediate plane 35. The position of the bridge sliding surface 6, the activation plate 7 and the bracket 18 can also be seen. Here, the application roller 4 and the bearing 3 are on the same side with respect to the longitudinal axis 34 when a cross-section orthogonal to the bearing axis is considered.

Figure 6:
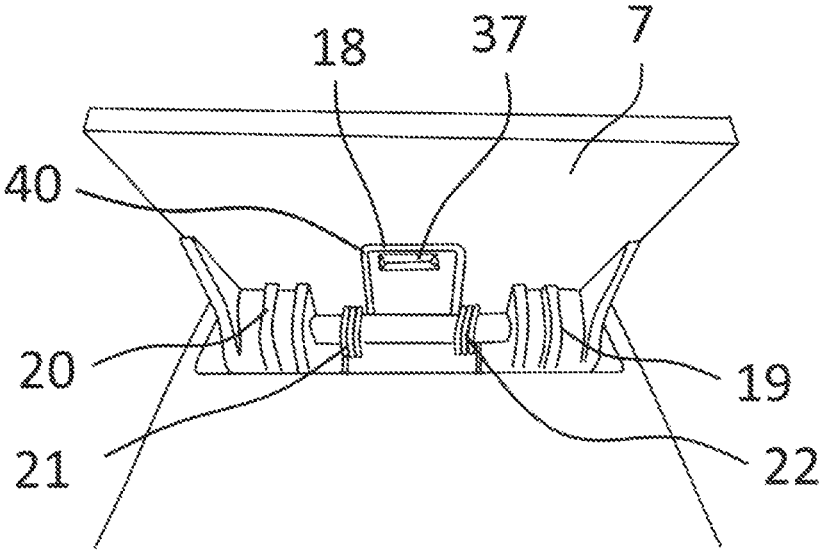
FIG. 6 shows a perspective view behind the activation plate.

FIG. 6 shows a perspective view behind the activation plate 7. The activation plate 7 comprises an activation plate spring 40 with a first wire 21 wound in helical form around a cross bar and a second wire 22 wound in helical form around a cross bar, the first and second wires 21, 22 being integrally connected by a bracket 18, the activation plate 7 having a recess and/or cantilever for fixing the bracket 18. The activation plate 7 comprises first and second reinforcing elements 19, 20. and a cantilever 37 for the bracket 18.

Figure 7:
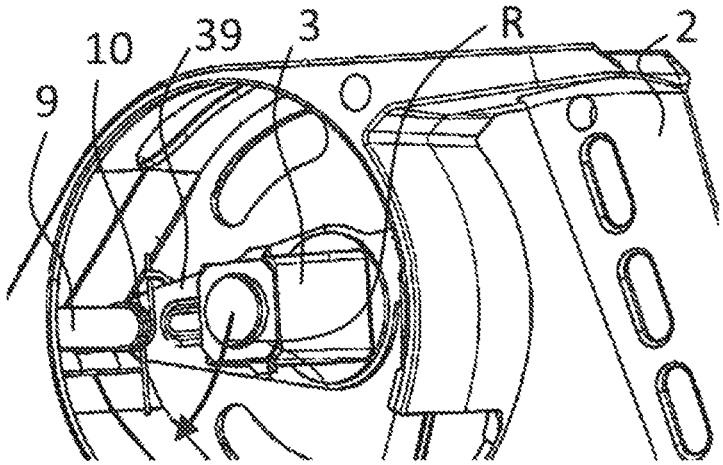
FIG. 7 shows a perspective view of the receiving device of at least one embodiment of the adhesive tape dispenser.

FIG. 7 shows a section of the receiving device 33 with a pivotable and rotatable bearing 3 in the first bearing position. The bearing 3 in the form of a central bearing has a square design here and can rotate about its own axis. It is fixed to a swivel arm 39, whereby the swivel arm 39 can be swiveled about the swivel rod 9. The swivel arm 39 is biased by the swivel arm spring 10 so that it automatically moves in the direction of the bridge sliding surface 6. Also shown is the handle 2. The swivel arm 39 is prestressed so that when it is released, it or the bearing 3 automatically swivels in the direction R of the bridge sliding surface, i.e., to the second bearing position.

Figure 8:
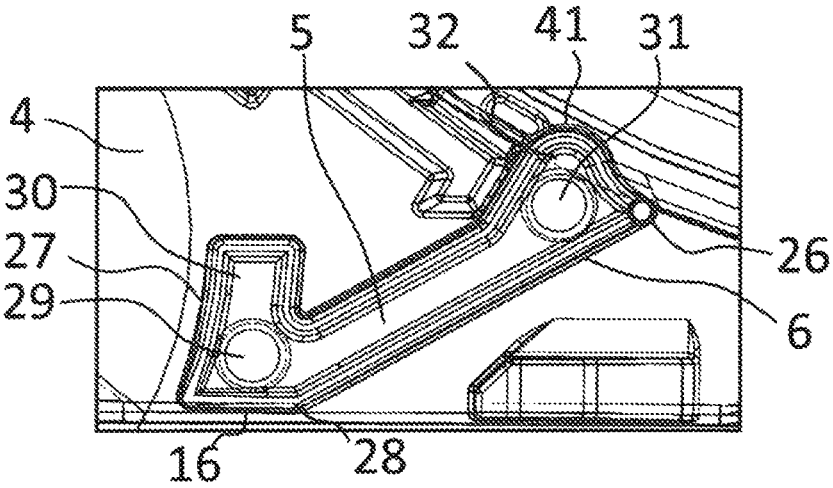
FIG. 8 shows a schematic cross-sectional view of a further embodiment of the friction bridge.

FIG. 8 shows a friction bridge 5 similar to FIG. 4, whereby here the deflection bead 26 is formed by a deflection pin. In all other respects, FIG. 8 is identical in construction to FIG. 4.

Figure 9:
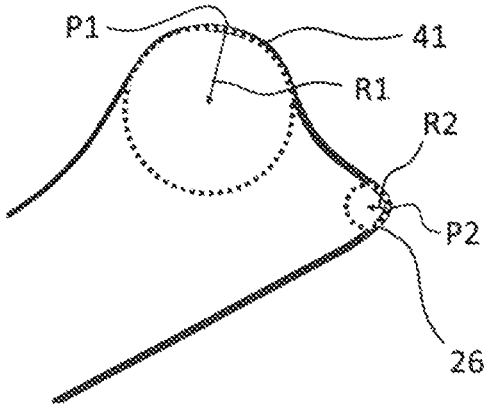
FIG. 9 shows a schematic cross-sectional view of a partial area of the embodiment of FIG. 4.

FIG. 9 shows a partial area of FIG. 4, namely the end of the friction bridge with the deflection bead 26 and the rounded contact bead 41. In cross-section, the rounded contact bead 41 has a rounded area with a first point P1 whose bevel circle has a first mean bevel circle radius R1. The deflection bead 26 has, in cross-section, a rounded area with a second point P2, the bevel circle of which has a second mean bevel circle radius R2. The second mean bevel radius R1 is many times smaller than the first mean bevel radius R2.

Figure 10:
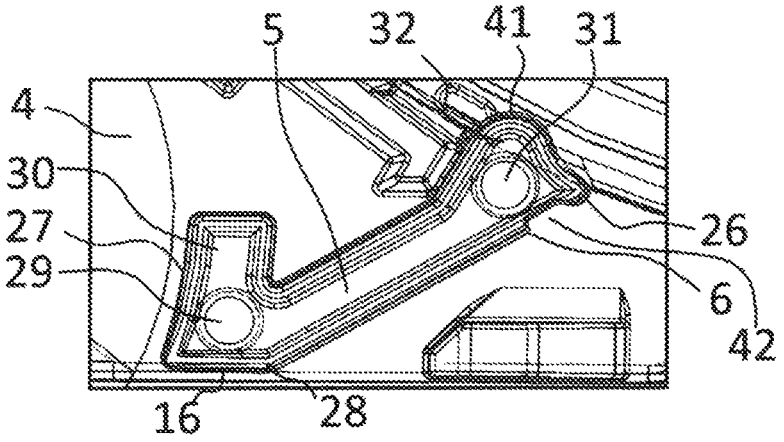
FIG. 10 shows a schematic cross-sectional view of a further embodiment of the friction bridge.

FIG. 10 shows a friction bridge 5 similar to FIG. 4, whereby here the deflection bead 26 is spaced from the bridge sliding surface 6 by a bridge recess 42. In principle, the deflection bead 26 can also be designed as a deflection pin spaced by the bridge recess 42 (not shown here). In all other respects, FIG. 8 is identical in construction to FIG. 4.

Figure 11:
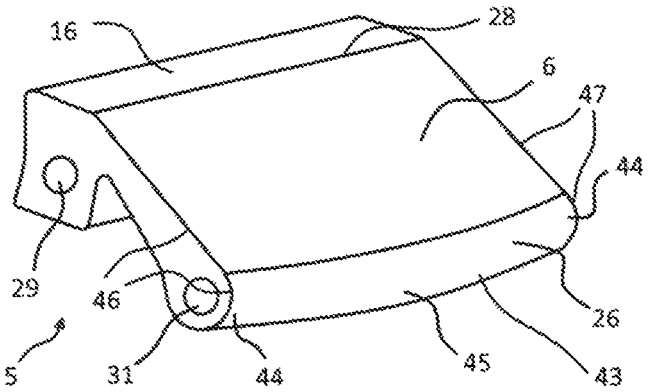
FIG. 11 shows a perspective view of a further embodiment of the friction bridge with a transverse elevation.

FIG. 11 shows an embodiment of the friction bridge 5 with the bridge sliding surface 6 and a deflecting bead 26 as well as a deflecting portion 28. In this embodiment, the bridge sliding surface 6 extends from the deflecting bead 26 to the deflecting portion 28. A surface 16 inclined relative to the bridge sliding surface 6 can also be seen, whereby these are separated from each other by the deflecting portion 28. A first and a second fixing element 29, 31 are provided. The deflecting bead 26 comprises a transverse elevation 43 in the form of a transverse curvature with a transverse elevation maximum 45 and two transverse elevation minimum 44. Said transverse elevation 43 extends between a first friction bridge side 46 and an opposite second friction bridge side 47. The transverse elevation maximum 45 is present at a distance from the friction bridge sides 46, 47, namely centrally between said friction bridge sides.

FIG. 12 again shows the design of the friction bridge 5 from a different perspective. With regard to the reference signs, please refer to FIG. 11. Also clearly visible here is a concave receiving curvature 27 of the friction bridge 5 in order to prevent friction on the application roller (cf. FIG. 1).

Figure 12:
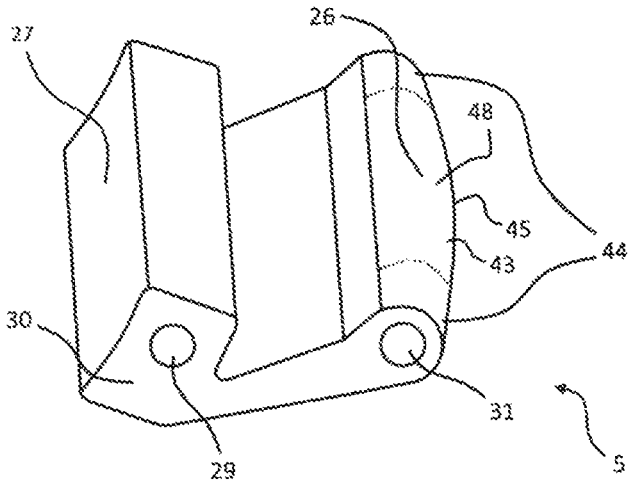
FIG. 12 shows a further perspective view of the embodiment with the transverse elevation of FIG. 11.
Figure 13:
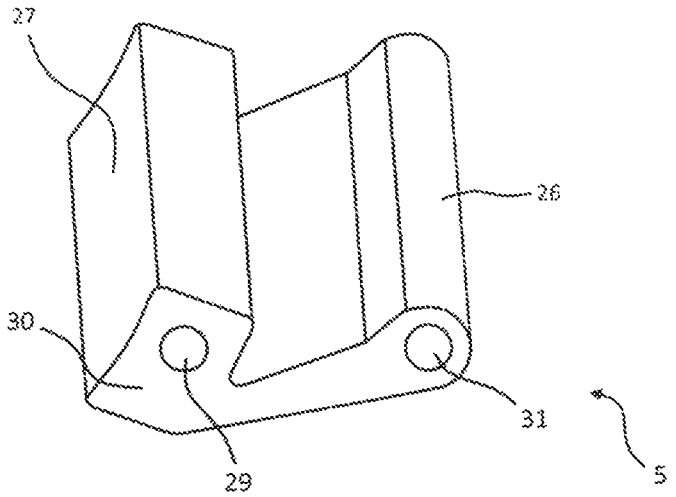
FIG. 13 shows a perspective view of a further embodiment of the friction bridge without the transverse elevation.

FIG. 13 shows an embodiment of the friction bridge analogous to FIG. 12 with a rounded contact bead 26, but without a transverse elevation. When a section of adhesive tape slides over this contact bead 26, all areas of the adhesive tape are in contact. It has been shown in many instances that such embodiments are somewhat more noisy than embodiments in which the adhesive tape edge is exposed.

Figure 14:
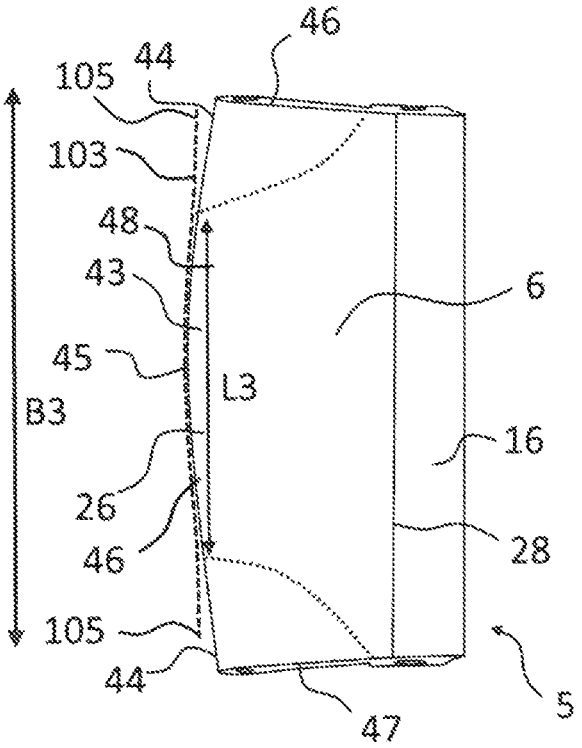
FIG. 14 shows a perspective view of a further embodiment of the friction bridge with the transverse elevation.

FIG. 14 shows a further embodiment of the friction bridge 5 with the bridge sliding surface 6 and a deflecting bead 26 as well as a deflecting portion 28. Apart from the fact that this embodiment of the friction bridge 5 is somewhat more elongated than the embodiment of FIGS. 11 and 12, the structure is identical and only the viewing angle is different. In this embodiment, the bridge sliding surface 6 extends from the deflection bead 26 to the deflection section 28. A surface 16 inclined relative to the bridge sliding surface 6 can also be seen, these being separated from one another by the deflection portion 28. The deflection bead 26 includes a transverse elevation 43 having a transverse elevation maximum 45 and two transverse elevation minima 44. Said transverse elevation 43 extends between a first friction bridge side 46 and an opposing second friction bridge side 47. The transverse elevation maximum 45 is spaced from the friction bridge sides 46, 47 and is centrally located between said friction bridge sides. Also shown is how the adhesive tape portion 103 abuts the deflection bead 26, with the adhesive tape edges 105 spaced from the deflection bead 26. The contact surface length L3 of the deflection contact surface 48 of the deflection bead 26 is less than the adhesive tape width B3 of the adhesive tape portion. The adhesive tape width B3 corresponds to the length of the dashed line of the adhesive tape portion 103 in FIG. 14.

Figure 15:
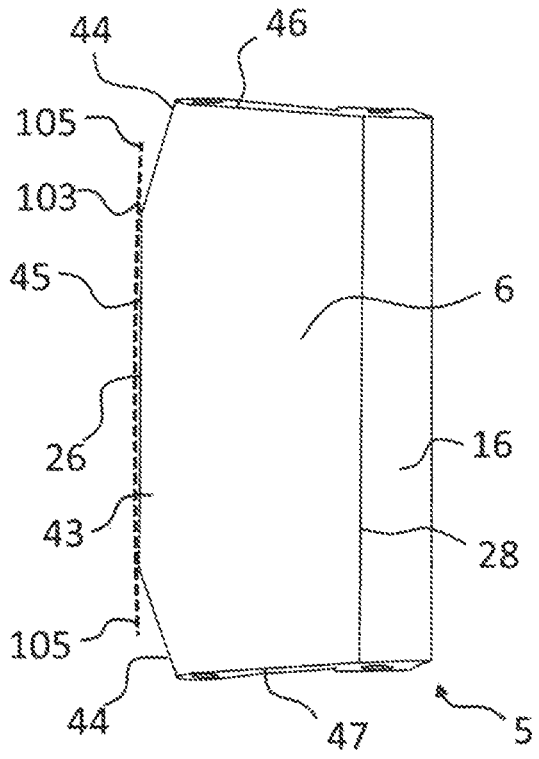
FIG. 15 shows a perspective view of a further embodiment of the friction bridge with the transverse elevation.

FIG. 15 shows a view analogous to FIG. 14, wherein the transverse elevation 43 is arranged as a polygonal transverse elevation. However, also here the deflection bead 26 comprises a transverse elevation maximum 45 and two transverse elevation minima 44, said transverse elevation 43 extending between a first friction bridge side 46 and an overlying second friction bridge side 47. The transverse elevation maxima 45 is spaced from the friction bridge sides 46, 47 and is centrally located between said friction bridge sides. In this embodiment, the transverse elevation has a cross-section in which it has two legs which comprise transverse elevation minima and a linear connecting line between the legs which comprises the transverse elevation maximum. Also shown is how the adhesive tape portion 103 abuts the deflection bead 26, with the adhesive tape edges 105 spaced from the deflection bead 26.

Figure 16:
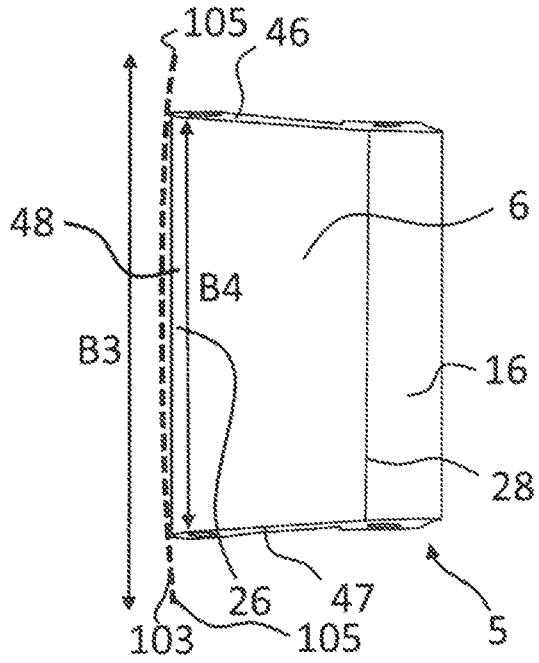
FIG. 16 shows a perspective view of a further embodiment of the friction bridge with a short deflection contact surface.

FIG. 16 shows a further embodiment of the friction bridge 5 with the bridge sliding surface 6 and a deflection bead 26 as well as a deflection section 28. The deflection bead 26 extends between the friction bridge sides 46, 47. The bridge sliding surface 6 extends from the deflection bead 26 to the deflection section 28. A surface 16 inclined relative to the bridge sliding surface 6 can also be seen, whereby these are separated from each other by the deflection section 28. The deflection bead 26 does not have a transverse elevation 43, but has a deflection contact surface 48 with a smaller contact surface length L3 than the adhesive tape width B3 of the adhesive tape portion 103, the adhesive tape edges 105 being spaced from the friction bridge 5.

Figure 17:
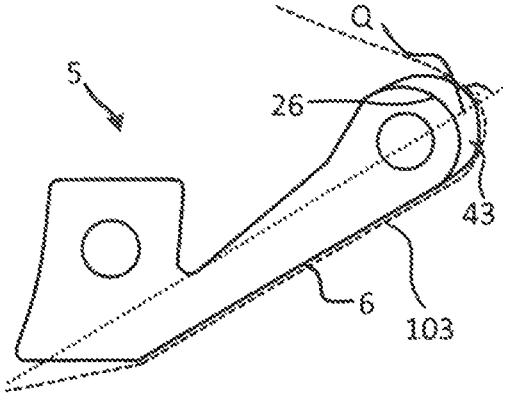
FIG. 17 shows a schematic side view of the friction bridge.

FIG. 17 shows a schematic view of some embodiments of the friction bridge 5. The transverse elevation has at least one cross-section Q which extends orthogonally to the deflection sliding surface and which at the same time extends parallel to the bridge sliding surface. It can also be seen how the adhesive tape portion 103 is guided around the friction bridge 5 and is deflected at the deflection bead 26 with transverse elevation 43.

Figure 18:
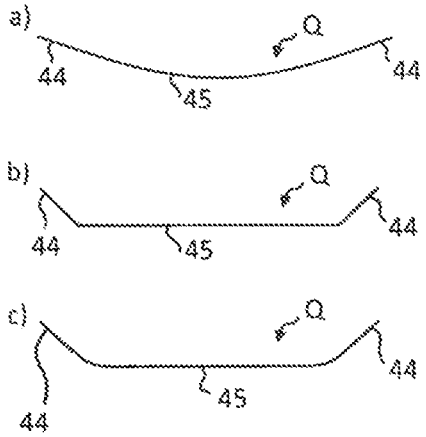
FIG. 18 shows a schematic view of some cross sections through the transverse elevation of various embodiments.

FIG. 18 shows some embodiments of the cross-sections Q of the transverse elevation 43. The cross-sections through the remaining friction bridge 5 only goes around the contour of the transverse elevation 43 in a cross-section as shown in FIG. 17. FIG. 18 *a*) concerns the cross section Q of a transverse elevation with a transverse elevation maximum 45 and two transverse elevation minima 44. FIG. 18 *b*) concerns the cross section Q of a polygonal transverse elevation with a transverse elevation maximum 45 and two transverse elevation minima 44. FIG. 18 *c*) concerns the cross-section Q of a further embodiment of a transverse elevation with a transverse elevation maximum 45 and two transverse elevation minima 44. In each of the cross-sections Q, the transverse elevation is visible as a raised and/or curved contour.

Figure 19:
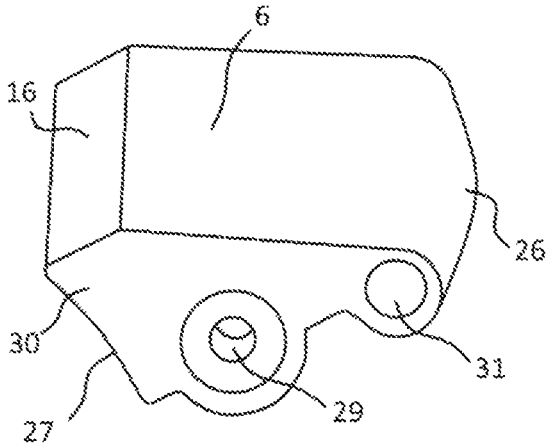
FIG. 19 shows a schematic view of a further embodiment of the friction bridge.

FIG. 19 shows a further embodiment of the friction bridge with rounded contact bead 26 and a transverse elevation. The inclined surface 16 adjoins the bridge sliding surface 6. A receiving curvature 27 is encompassed by the friction bridge. A first and a second mechanical fixing element 29, 31 are also seen as optional components.

The features of the disclosure disclosed in the foregoing description, claims, and drawings may be essential, both individually and in any combination, to the realization of the disclosure in its various embodiments.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

REFERENCES

1 adhesive tape dispenser
2 handle
3 bearing for an adhesive tape roll
4 application roller
5 friction bridge
6 bridge sliding surface
7 activation plate
8 crossbar for the activation plate
9 pivot rod for the pivoting of the bearing
10 swivel arm spring
11 connector between the handle and the rest of the adhesive tape dispenser
12 semi-open cylindrical housing for the adhesive tape roll
13 handle holes
14 first fixing cantilever
15 second fixing cantilever
16 inclined surface
17 legs of the semi-open cylindrical housing for the rotatable fixation of the application roller
18 bracket
19 first reinforcing element
20 second reinforcing element
21 first wire
22 second wire
23 cutting blade
24 end sliding surface
25 receiving block for cutting blade
26 deflection bead
27 receiving curvature
28 deflection portion
29 first mechanical fixing element
30 first stiffening leg
31 second mechanical fixing element
32 second stiffening leg
33 receiving apparatus
34 longitudinal axis or handle axis
35 intermediate plane
36 recess
37 cantilever
38 application apparatus
39 swivel arm
40 activation plate spring
41 rounded contact bead
42 bridge recess
43 transverse elevation
44 transverse elevation minimum
45 transverse elevation maximum
46 first friction bridge side
47 second friction bridge side
48 deflection contact surface
100 adhesive tape roll
102 adherent adhesive tape side
103 adhesive tape portion
104 non-adherent adhesive tape side
105 adhesive tape edges
A1 bearing axis
A2 swivel arm axis
A3 application roller axis
L1 application roller length of the application roller
L2 sliding surface length of the bridge sliding surface
L3 contact surface length of the deflection contact surface
B1 sliding surface width of the bridge sliding surface
B2 bridge width of the friction bridge
B3 adhesive tape width of the adhesive tape
P1 first point
P2 second point
R direction towards the bridge sliding surface
R1 first bevel circle radius
R2 second bevel circle radius
X line
Q cross-section through deflection bead

The invention claimed is:

1. An adhesive tape dispenser, comprising:

a handle, a receiving apparatus having a bearing for an adhesive tape roll, an application apparatus having an application roller, and a rotation-resistant fixed friction bridge having a bridge sliding surface and a deflection bead, wherein the adhesive tape dispenser is adapted and arranged such that, during unwinding, an adhesive tape portion of an adhesive tape roll present on the bearing slides or is slidable over the deflection bead before the adhesive tape portion meets the application apparatus; and wherein the adhesive tape portion of the adhesive tape roll has adhesive tape edges, and wherein the deflection bead comprises a transverse elevation that is adapted and arranged to distance the adhesive tape portion at the adhesive tape edges from the deflection bead, while the adhesive tape portion contacts the transverse elevation away from the adhesive tape edges, the adhesive tape dispenser further comprising a cutting apparatus, which cutting apparatus is transferable from a shielded first cutting position into a second cutting position in which the cutting apparatus protrudes freely, wherein the adhesive tape dispenser comprises a prestressed activation apparatus, wherein the prestressed activation apparatus, if it is loaded with pressure and/or is moved, transfers the cutting apparatus in a direction opposite to the movement direction of the activation apparatus, into the second cutting position in which the cutting apparatus, at least in sections, protrudes freely, and wherein the activation apparatus comprises a spring having a first wire helically wound around a crossbar and a second wire helically wound around a crossbar, wherein the first wire and the second wire are integrally connected by a bracket, and wherein the activation apparatus has a recess and/or cantilever arm for fixing the bracket.

2. The adhesive tape dispenser according to claim 1, wherein the handle is in the form of a radial handle or tangential handle.

3. The adhesive tape dispenser according to claim 2, wherein the handle is in the form of a radial handle having a longitudinal axis, and wherein:

the longitudinal axis and the application roller are located on opposite sides of an intermediate plane, wherein the intermediate plane is arranged parallel to the longitudinal axis and a bearing axis of the bearing is arranged in the intermediate plane, or the application roller and the bearing are located on a same side with respect to the longitudinal axis, when viewing a cross-section orthogonally to the bearing axis.

4. The adhesive tape dispenser according to claim 1, wherein the friction bridge or at least the bridge sliding surface and/or the deflection bead comprise or comprises a plastic.

5. The adhesive tape dispenser according to claim 1, further comprising an end sliding surface for the adhesive tape portion.

6. The adhesive tape dispenser according claim 1, wherein the adhesive tape dispenser is adapted for an adhesive tape roll having an adhesive tape width and the deflection bead comprises a deflection contact surface, and wherein, during use of the adhesive tape dispenser, when said adhesive tape portion slides over the deflection bead, its adhesive tape edges are at a distance, at least in sections, from the deflection contact surface.

7. The adhesive tape dispenser according to claim 6, wherein the adhesive tape dispenser is adapted for an adhesive tape roll having an adhesive tape width of at least 4.7 cm and the deflection contact surface has a contact surface length of less than 4.3 cm.

8. The adhesive tape dispenser according to claim 1, wherein the bearing for an adhesive tape roll is pivotable into such a position that a line connecting an application roller axis of the application roller and a bearing axis of the bearing is definable, which line runs substantially parallel to at least one portion of the bridge sliding surface.

9. The adhesive tape dispenser according to claim 1, wherein the friction bridge is connected at at least three linkage points to the adhesive tape dispenser.

10. The adhesive tape dispenser according to claim 1, wherein the friction bridge comprises a deflection portion, wherein the deflection portion is closer to the application roller than the deflection bead.

11. The adhesive tape dispenser according to claim 1, wherein the adhesive tape dispenser comprises an adhesive tape roll and an adhesive tape portion unwound from the adhesive tape roll, which adhesive tape portion is connected to the adhesive tape roll, wherein the adhesive tape portion has an adherent adhesive tape side and an opposite, non-adherent adhesive tape side, wherein the opposite, non-adherent adhesive tape side lies in contact, with a partial region, with the deflection bead.

12. A method for noise-reduced application of adhesive tape using an adhesive tape dispenser according to claim 1, wherein an adhesive tape portion is guided, during application, around the deflection bead, and the adhesive tape edges of the adhesive tape portion are distanced, at least in regions, from said deflection bead, while the adhesive tape portion rests centrally on the deflection bead.

13. The adhesive tape dispenser according to claim 1, wherein the bearing of the receiving apparatus is a pivoting or rotatable bearing, wherein the application roller of the application apparatus is a rotatable application roller, and wherein the adhesive tape portion slides or is slidable over the transverse elevation or a deflection contact surface of the deflection bead.

14. The adhesive tape dispenser according to claim 3, wherein the bearing axis of the bearing is arranged in the intermediate plane in a first bearing position.

15. The adhesive tape dispenser according to claim 4, wherein the plastic is selected from the group consisting of polyamide, polycarbonate, acrylonitrile butadiene styrene, styrene-acrylonitrile copolymer, polyacetals, polyurethane, polyketone, polyester urethane rubber, polyetherketone, polymethacrylate, and any mixtures thereof.

16. The adhesive tape dispenser according to claim 1, wherein the cutting apparatus is a cutting blade having a dentation.

17. The adhesive tape dispenser according to claim 10, wherein the adhesive tape dispenser is constructed such that, during unwinding, an adhesive tape portion of an adhesive tape roll slides over the deflection portion and is deflected there or separates from the friction bridge.

18. The adhesive tape dispenser according to claim 1, wherein the activation apparatus is an activation plate.

19. An adhesive tape dispenser, comprising:

a handle, a receiving apparatus having a bearing for an adhesive tape roll, an application apparatus having an application roller, and a rotation-resistant fixed friction bridge having a bridge sliding surface and a deflection bead, wherein the adhesive tape dispenser is adapted and arranged such that, during unwinding, an adhesive tape portion of an adhesive tape roll present on the bearing slides or is slidable over the deflection bead before the adhesive tape portion meets the application apparatus, wherein the bearing for the adhesive tape roll is pivotable between a first bearing position and a second bearing position, wherein the bearing is fastened to a swiveling arm which is connected to a prestressed swiveling arm spring, wherein the swiveling arm spring presses the swiveling arm and the bearing in a direction of the second bearing position, and wherein the bearing is closer to the deflection bead of the friction bridge in the second bearing position than in the first bearing position.

20. The adhesive tape dispenser according to claim 19, wherein the handle has a longitudinal axis, wherein the longitudinal axis and the application roller are located on opposite sides of an intermediate plane, and wherein the intermediate plane is arranged parallel to the longitudinal axis and a bearing axis of the bearing lies within the intermediate plane in the first bearing position.

* * * * *